United States Patent [19]

Meissner et al.

[11] 4,388,955

[45] Jun. 21, 1983

[54] VACUUM FILLER

[75] Inventors: Konrad E. Meissner, Lafayette; Grant R. Merritt, Livermore, both of Calif.

[73] Assignee: Atlas Pacific Engineering Company, Emeryville, Calif.

[21] Appl. No.: 241,484

[22] Filed: Mar. 9, 1981

[51] Int. Cl.[3] ..... B65B 3/04

[52] U.S. Cl. ..... 141/286; 141/392

[58] Field of Search ..... 141/37–73, 141/34, 305, 286, 285, 287–310, 392

[56] References Cited

U.S. PATENT DOCUMENTS

| | | | |
|---|---|---|---|
| 2,243,451 | 5/1941 | Bauer | 141/286 |
| 2,543,788 | 3/1951 | Loveland | 141/305 |
| 2,903,023 | 9/1959 | Battinich | 141/305 |
| 2,914,097 | 11/1959 | Batinich | 141/305 |
| 3,990,487 | 11/1976 | Loveland | 141/305 |

*Primary Examiner*—Houston S. Bell, Jr.
*Attorney, Agent, or Firm*—James F. Mitchell

[57] ABSTRACT

A vacuum filler is described which has an improved filling head particularly adapted for vacuum filling steel cans containing more-or-less compressible and tacky food products, such as tuna fish or salmon, with filling liquids of low viscosity, such as vegetable oil or water.

8 Claims, 6 Drawing Figures

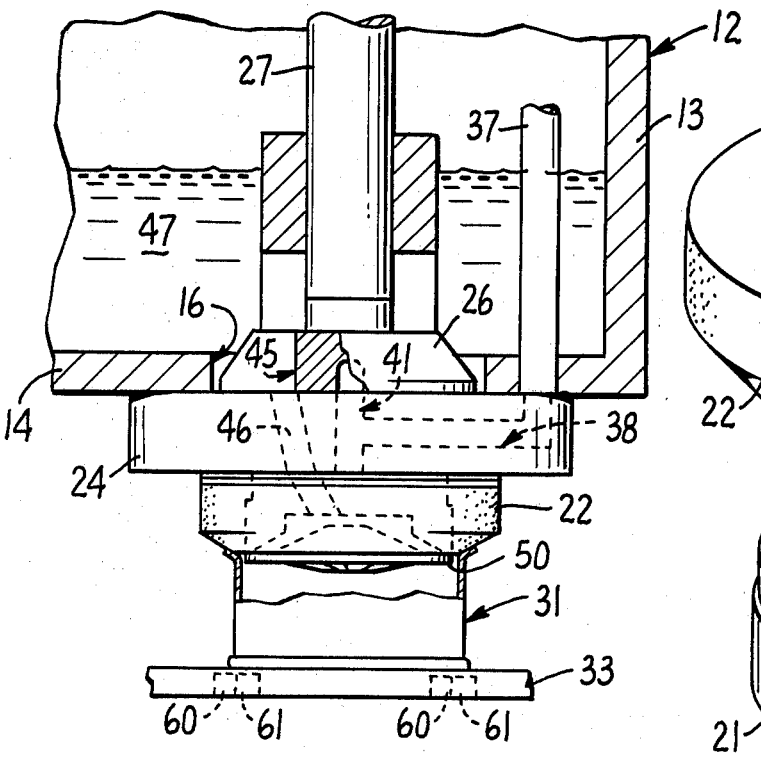
FIG. 1.
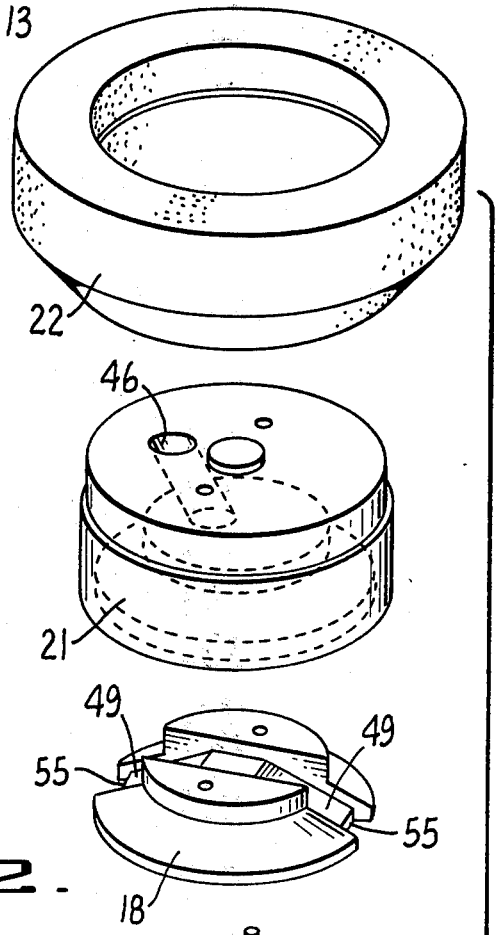
FIG. 2.
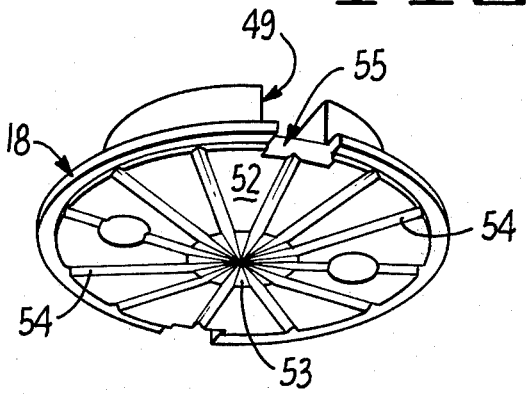
FIG. 3.
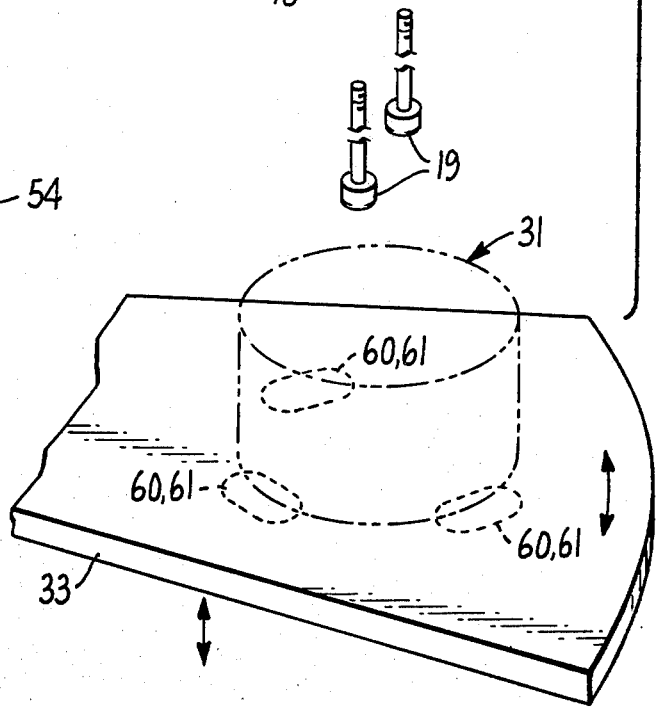

VACUUM FILLER

BACKGROUND OF THE INVENTION

This invention is an improvement upon vacuum filler equipment of the type described in U.S. Pat. No. 2,543,788 issued Mar. 6, 1951 to M. W. Loveland, in Battinich U.S. Pat. No. 2,903,023 and in Loveland U.S. Pat. No. 3,990,487 issued on Nov. 9, 1976. The filling head is similar to and an improvement upon those shown in the latter patent.

Most present packing methods for tuna and other fish products use drip-filling or spray methods for filling the liquids used in packing them. These liquids normally are low-viscosity, relatively fluid vegetable oils or water which tend to be centrifically flung from the vacuum filling heads at machine positions where the filling head is not in sealing engagement with the container being filled. The drip and spray methods result in a substantial amount of filling oil, for example, actually being lost or that which can be recovered must be recycled or discarded if too contaminated.

The vacuum filler of this invention is particularly useful for filling steel cans containing more-or-less compressible and tacky material, such as tuna fish or salmon, with the non-viscous liquids normally used for packing those products. In attempting to modify equipment such as that shown in Loveland Pat. Nos. 2,543,788 and 3,990,487 for tuna fish service, for example, applicants have found that the packed tuna fish tended to cling to the generally concave surface of the kind of displacement pad or disc illustrated in those patents. The adhered particulate matter was subsequently drawn into and contaminated the filler vacuum system.

SUMMARY OF THE INVENTION

The vacuum filler of this invention economically fills steel cans containing more-or-less compressible and tacky fish products with the non-viscous filling liquids with which such products are normally packed without substantial liquid loss or vacuum system problems.

One object of this invention is to provide a filling head which, when handling filling liquids of low viscosity, does not centrifically fling the filling liquid from the heads at machine positions wherein the head is not in sealing engagement with the container being filled.

Another object of the invention is to provide a vacuum filler which readily disengages from packed more-or-less compressible and tacky food products within the container after it has been filled without residual packed product clinging upon the displacement disc.

Another important objective of the invention is to minimize the amount of filling liquid which is lost by centrifugation or drippage at machine positions wherein the filling head is not in sealing engagement with the container.

Other objects and advantages of the invention will become apparent to those skilled in this art upon consideration of the following description and the accompanying drawings.

BRIEF DESCRIPTION OF THE DRAWINGS

FIG. 1 is a partial vertical sectional view of the bottom valve and filling head of this invention mounted upon the filling bowl during the liquid filling step of a typical vacuum filling machine;

FIG. 2 is a exploded view of the filling head of this invention in relation to the container to be filled;

FIG. 3 is a perspective view of the convex radially grooved displacement surface of the displacement disc of the filler head;

DESCRIPTION OF THE PREFERRED EMBODIMENT

FIGS. 1 and 2 illustrate the improved filling head of this invention mounted upon the bottom valve of a typical filling bowl of a vacuum filler as is generally described in Loveland U.S. Pat. Nos. 3,990,487 and 2,543,788. In such vacuum fillers, one or more filling heads mount upon bottom valves arranged along the bottom of a filling bowl which rotates about a vertical axis typically at 15–20 rpm. Means on the machine lift containers to be filled into engagement with each of the several filling heads and, after filling, withdrawn and disengage each container from the head. In the embodiment described, each container is initially packed with fish products such as tuna fish or salmon and is moved into sealing engagement with the filling head by a support platform means. The filling head partially evacuates the container and its displacement disc defines a predetermined head-space clear of packed fish within the container. The bottom valve then indexes to admit filling liquid from the filling bowl into the evacuated space within the container. The bottom valve then vents the filled container to atmosphere and in a last step the container support platform withdraws the filled container from the filling head. Each filled container then is guided from the machine by a guide rail usually as the bottom valve closes.

In FIG. 1 the bottom valve and filler head are shown mounted upon a filler bowl 12 which has a sidewall 13 and bottom wall 14 and a bottom opening 16 within which a typical one of the bottom valve and filler head combinations mounts. The foregoing and subsequent numbering corresponds to that of U.S. Pat. No. 3,990,487 for clarity in illustrating corresponding parts and their mode of operation.

Figure 4:
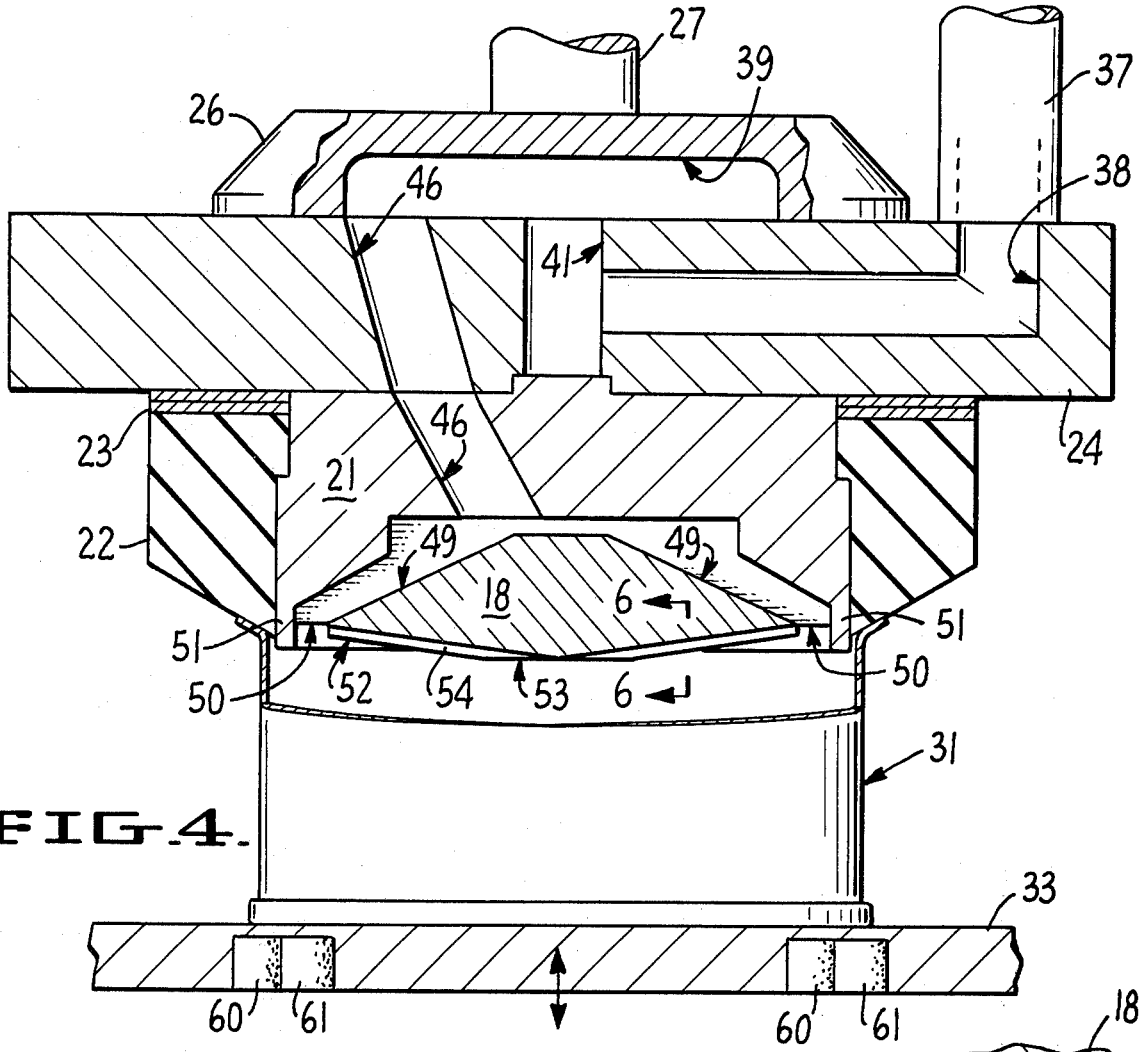
FIG. 4 is a vertical sectional view of the bottom valve and filling head of this invention during the vacuumizing step for the vacuum filling machine.

The filler head includes a displacement disc 18 secured by cap screws 19 to a holder 21. The holder 21 receives a ring-shaped resilient container seal 22 around its periphery. The seal is usually made from rubber that is resistant and non-contaminating for the service in which the seal is employed. The holder 21 mounts on bottom valve seat 24 with spacing washers 23, as shown in FIG. 4, between them to properly locate the sealing surface of the container seal 22 with respect to the holder lip which is hereinafter described. The bottom valve seat 24 is secured to bottom wall 14 in the opening 16 of the bowl 12. A bottom valve plate 26 rotatably mounts on the bottom valve seat 24 upon shaft 27 which is driven by a four point star, not shown and which is more particularly described in U.S. Pat. No. 3,990,487.

As is also described in that patent, pipe 37 selectively communicates a source of vacuum or atmosphere to passages 38 and 41 bored in the bottom valve seat 24. The bottom valve plate 26 carries an elongated passage 39 cut in its lower face which at 180° positions of the bottom valve plate selectively communicates passage 41 to a through passage 46 in the bottom valve seat 24 as is shown in FIG. 4 for the vacuumizing and venting positions. Through passage 46 aligns with corresponding through passage 46 bored in holder 21. Bottom valve plate 26 also is provided with a port 45, which in the liquid filling position shown in FIG. 1, communicates with the interior of filling bowl 12 and permits filling liquid 47 to pass to the through passages 46 in the bottom valve seat 24 and holder 21.

As can be more particularly seen in FIGS. 1, 2 and 4, the through passage 46 in holder 21 by means of passages 49 defined by it and the displacement disc 18 communicates with an annular opening 50 defined between the lower surface 52 of the displacement disc 18 and a downwardly extending lip 51 formed around the lower periphery of the holder 21. The lip 51 extends downwardly from the annular opening 50, from the corresponding lower surface 52 of the displacement disc 18 and from the sealing surface of container seal 22.

The lower surface 52 of the displacement disc 18 faces the contents of the container 31 and, when the container engages the container seal 22, it contacts and pushes those contents downwardly to provide a uniform head-space among the cans being filled as is more particularly described in U.S. Pat. No. 3,990,487. The lower surface 52 of the disc is generally convex. In the described embodiment for ease of machining, it is illustrated as having a conical surface 52 with a flat 53 at the disc center. Other generally convex surfaces are also useful in this invention. All of them prevent more-or-less compressible and tacky products like tuna fish and salmon from sticking to the displacement disc surface 52. That is the difficulty which applicants have experienced with the generally concave displacement discs of the machines illustrated in U.S. Pat. No. 2,543,788, for example, which are the type normally used on commercial machines of this type.

Figure 6:
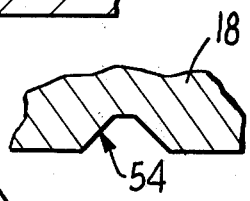
FIG. 6 is a partial sectional view taken along line 6—6 of FIG. 4 showing a configuration of radial groove in the displacement disc which has been found useful for the fish packing service for which the invention is particularly suited.
Figure 5:
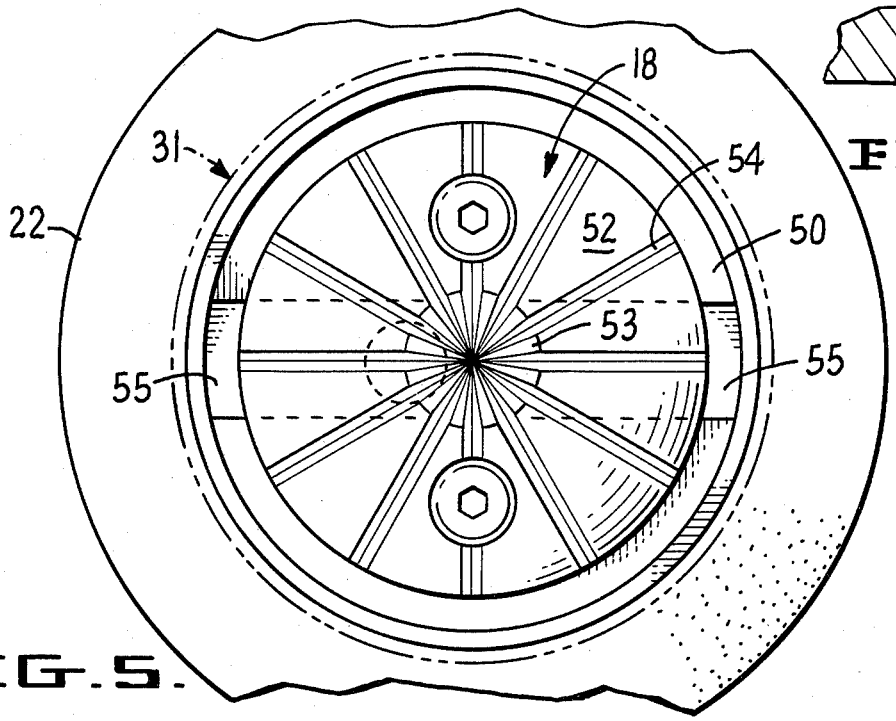
FIG. 5 is a bottom view of the filling head of FIG. 4.

Applicants have discovered also that radial grooves 54 in the configuration shown in FIG. 6 are particularly useful to further assist in removal of the filled container 31 and its contents from the displacement disc 18 without clinging of residual fish product.

In order to better distribute filling liquids such as the non-viscous vegetable oils and water used for fish products, the annular opening 50 between the displacement disc surface 52 and holder lip 51 is enlarged by recesses 55 cut in the disc periphery. Two recesses are shown. One or even more could be used also.

Coated steel cans are frequently used for packing fish products. Taking advantage of this container material the container support platform 33 of the described embodiment carries at each container location, sets of pairs of double-pole permanent magnets 60,61 which provide a very substantial vertical force upon the supported steel container to assist its withdrawal downwardly from the displacement disc surface 52 during the subsequently described removal step after filling. These magnetic means are partially important for disengaging low weight filled cans, in the order of eight ounces or less, from the disc surface 52 when they are packed with tacky products.

In a first vacuuming position, the container platform 33 lifts the open top container 31 into sealing engagement with container seal 22. The bottom valve plate 26 is as shown in FIG. 4 with the vacuum source communicated by a chambered shoe, such as that shown in U.S. Pat. No. 3,990,487, through pipe 37 via passages 38 and 41, passage 39, passages 46, and passages 49 to the annular opening 50 that communicates with the interior of the container 31 to be filled in this raised position. A partial vacuum is drawn upon the air space within the container and the displacement disc 18 defines a uniform head-space over the contained fish product. The head-space, thus, can be made uniform from can to can. In doing so, the displacement disc generally contacts the more-or-less compressible and tacky fish product.

In a next operational position as the bowl rotates the star wheel illustrated in U.S. Pat. No. 3,990,487 through shaft 27 indexes bottom valve plate 26 to the position illustrated in FIG. 1 wherein its port 45 communicates the liquid 47 carried within the bowl 12 through passages 46 and 49 to annular opening 50 and into the interior of the container 31. The container is filled with liquid to a predetermined level.

In a third position, the star wheel shaft 27 indexes the bottom valve plate 26 to a position 180° from its vacuumizing position, again as shown in FIG. 4, wherein passage 39 also communicates the through passage 46 to pipe 37. The pipe in this operational step is vented to atmosphere as is more particularly described in U.S. Pat. No. 3,990,487.

Then in a final position, the star wheel through shaft 27 closes the filler valve as container support platform 33 withdraws the container 31 with the assistance of magnets 60,61 (for steel containers) from the raised position and all contact of its flanged mouth with the container seal 22 as is also more particularly explained in U.S. Pat. No. 3,990,487. In this lowered position of non-sealing engagement the lip 51 on holder 21 prevents filling liquid from being centrifically flung from the filling head and actually guides any drippage into the open container at least until it is moved from the machine by a guide rail or other means. The magnetic field of magnet means 60,61 is weak in shear and easily permits horizontal can movement out of the machine.

The convex shape of the displacement disc surface 52 and its radially grooves configuration are believed to break more easily the surface tension between packed material and the displacement disc surface to enable disengagement without residual packed material clinging to the disc surface as had been experienced with prior art concave configurations.

The described embodiment is the preferred form of the invention. Various modifications such as in the particular convex displacement disc surface configuration used or the mounting method for magnet means in the support platform, will be apparent without departing from the scope of the invention which is defined in the following claims.

We claim:

1. In a vacuum filler for containers having a bowl containing filling liquid, a bottom valve attached to the underside of the bowl with a bottom valve seat including a through passage and a bottom valve plate in rotatable contact with the bottom valve seat to connect the through passage of the bottom valve seat in sequence selectively to a source of vacuum, to filling liquid contained in the bowl and to atmosphere, a filling head attached to the underside of the bottom valve seat having a holder carrying a container seal and a displacement disc with an aligned through passage that is in communication with the interior of the container to be filled when it is in sealing engagement with the filling head, the improvement comprising a generally convex surface on the displacement disc facing the container contents and a continuous peripheral lip on the holder radially outward from and depending below the adjacent portion of said convex surface of the disc.

2. The improvement of claim 1 wherein the generally convex surface of the displacement disc has a plurality of radially extending grooves formed in said surface.

3. The improvement of claim 1 wherein the holder and displacement disc form between them an annular opening in communication with said container interior.

4. The vacuum filler of claim 1 further including platform means for moving the container to be filled into and out of sealing engagement with the container seal wherein the platform carries magnetic means underlying the container carrying location to assist in disengagement of the filled container from said seal and displacement disc.

5. An improved filling head for a vacuum filler for containers including a holder;

a container seal mounted on the periphery of said holder for sealing engagement with the open mouth of a container to be filled;

a displacement disc mounted upon the holder and defining with the holder an annular opening therebetween in communication with the interior of the container to be filled when in sealing engagement with said container seal;

said holder having a through passage in communication with the annular opening for selective communication of vacuum, of filling liquid and of atmospheric pressure to said annular opening; and said holder also having a downwardly depending lip extending below said annular opening to control flow of the filling liquid.

6. The improved filling head of claim 5 wherein the face of the displacement disc facing the container contents is generally convex.

7. The improved filler head of claim 5 wherein the convex surface of the displacement disc carries a plurality of radial grooves.

8. The improved filler head of claim 5 wherein the annular opening between the holder and displacement disc in at least one radial location is widened by a recess cut in the displacement disc.

* * * * *